US007337990B2

(12) United States Patent
Kurosaka et al.

(10) Patent No.: US 7,337,990 B2
(45) Date of Patent: Mar. 4, 2008

(54) ATTACHMENT FOR AIR SPRAY GUN

(75) Inventors: Shingo Kurosaka, Yokohama (JP); Kunihisa Tomita, Yokohama (JP)

(73) Assignee: Anest Iwata Corporation, Kanagawa-ken (JP)

( * ) Notice: Subject to any disclaimer, the term of this patent is extended or adjusted under 35 U.S.C. 154(b) by 0 days.

(21) Appl. No.: 11/378,240

(22) Filed: Mar. 20, 2006

(65) Prior Publication Data

US 2006/0214034 A1 Sep. 28, 2006

(30) Foreign Application Priority Data

Mar. 24, 2005 (JP) ..... 2005-085906

(51) Int. Cl.
*B05B 15/08* (2006.01)

(52) U.S. Cl. ..... 239/587.2; 239/587.6; 239/587.1; 239/346; 239/74; 285/190; 285/273; 285/93; 132/580

(58) Field of Classification Search ..... 239/345, 239/347, 379, 346, 307, 375, 390, 587.1–588, 239/74, 373, 337; 285/190, 93, 147.1, 272; 137/552, 580; 134/102.2, 196 A
See application file for complete search history.

(56) References Cited

U.S. PATENT DOCUMENTS 3,166,252 A * 1/1965 O'Brien et al. ..... 239/587.6
3,411,526 A * 11/1968 Schaefer ..... 137/312
4,823,835 A * 4/1989 Chu ..... 137/557
5,119,992 A * 6/1992 Grime ..... 239/364
5,372,389 A * 12/1994 Tam et al. ..... 285/94
5,636,877 A * 6/1997 Purvis et al. ..... 285/45
6,450,422 B1 * 9/2002 Maggio ..... 239/345

* cited by examiner

*Primary Examiner*—Dinh Q. Nguyen
(74) *Attorney, Agent, or Firm*—Wenderoth, Lind & Ponack, L.L.P.

(57) ABSTRACT

There is provided an attachment for an air spray gun, to be connected to the bottom of a grip of the spray gun. It includes a control valve to adjust the air flow rate, a gun coupling disposed in the body of the control valve to communicate with an outlet-side passage and thus connect to the spray gun, and a rotary joint having a hose coupling fixed thereto and which is to be fitted rotatably into an inlet-side passage to allow the hose coupling to communicate with the inlet-side passage. The hose coupling is freely turned in relation to the gun coupling fixed to the spray gun for the angle formed between them to freely be variable. A pressure gauge is installed on the attachment to communicate with the outlet-side passage and indicate the pressure of air supplied through the passage. The display surface of the pressure gauge forms an obtuse angle in relation to the axis of the gun coupling.

8 Claims, 2 Drawing Sheets

ATTACHMENT FOR AIR SPRAY GUN

BACKGROUND OF THE INVENTION

1. Field of the Invention

The present invention generally relates to an air spray gun that atomizes a paint or the like under the action of pressurized air and sprays the resultant paint mist to an object which is to be coated with the paint, and more particularly, to an attachment which is to be connected to an air inlet of the air spray gun to adjust and check the pressure of air introduced through the air inlet into the spray gun.

2. Description of the Related Art

The air spray gun is used to atomize a paint under the action of pressurized air and spray the paint mist produced as above. Therefore, the quality of a paint coating thus formed depends upon the condition of such pressurized air. Normally, the worker using the spray gun checks the air pressure at the time of spraying a paint. In case it is necessary to change the spraying conditions correspondingly to a surface variation of an object to be coated and use of another paint, the worker has to adjust pressurized air for supply to the air spray gun by operating a pressure reducing valve or the like provided in the middle of a supply passage from an air source until an air pressure required for the spraying is attained. Also, for continuously assuring a stable quality of the coating, it is necessary to keep a constant air pressure and check the air pressure during spraying as well.

Normally, the air spray gun is supplied with pressurized air whose pressure has been adjusted at an air compressor or the like located away from the spray gun. Therefore, many of the air spray guns have no air pressure control provided on themselves. When changing the air pressure or adjusting it to a correct level, the worker has to leave the working site and go to the air compressor located away from the site to adjust a regulating valve of the compressor. Thus, the worker has to interrupt the coating work at each time of the adjustment. To solve the above problem, there have been proposed some air spray guns provided with a valve to adjust the air flow rate instead of adjusting the spraying pressure. With such a valve, the worker can adjust the spraying pressure but cannot still check the spraying pressure. In effect, the worker has to address the air pressure adjustment intuitively by experience.

Improvement in appearance, by the finish coating, of products of commerce is very important for raising the added value of the products as well as for economic use of an expensive paint having been used to meet the recent need for a higher quality. One of the basic coating techniques for the quality coating is to assure a correct spraying pressure. To solve the scattering of paint mist as a basic problem of the air spray gun, it has been required to improve the efficiency of paint adhesion for higher friendliness to the worker and environment. One of the possible solutions is to reduce the spraying pressure. The reduced spraying pressure has been proved to be practically effective for less scatting of the paint mist. The reduction of air pressure is legally required in some cases in which it will be required that the spraying pressure can be checked.

A spray gun incorporating a pressure gauge will be a solution to the above problem, but it will be expensive. Generally, however, a joint having a pressure gauge is connected to the air inlet of the spray gun when it is necessary to check the spraying pressure.

SUMMARY OF THE INVENTION

Most of air spray guns of a hand-held type are designed for use with an air hose being connected at one end thereof to the bottom of a grip and at the other end to a pressurized air source. The spray gun of this type will be operable with a highest stability because it is not influenced by the connected air hose. However, the air hose connected to the grip, extending to below the worker's hand holding the spray gun, will interfere with the spraying work as the case may be even if it is flexible. For example, an obstacle, if any, below the spray gun held by the worker will be in contact with the air hose extending downward, which will make it difficult to operate the spray gun accurately. In this respect, the aforementioned coupling with a pressure gauge will be more disadvantageous for spray coating with the spray gun.

It is therefore preferable to overcome the above-mentioned drawbacks of the related art by providing an attachment for a spray gun, usable with the latter with less limitation, by an air hose, of operationality and moving range of the spray gun and permitting easy checking of the spraying pressure.

According to the present invention, there is provided an air spray gun attachment which is to be connected to the bottom of a grip of the spray gun and to which a compressed air supply hose is to be connected, the attachment including:

a control valve disposed in the middle of an air passage through the attachment to adjust the rate of air flow through the air passage;

a gun coupling disposed on the outer surface of the control valve to communicate with the passage at the outlet side and which is to be connected to the spray gun; and a rotary joint having a hose coupling to which an air hose is to be connected and which is to be fitted rotatably into the inlet-side passage to allow the hose coupling to communicate with the inlet-side passage, the angle formed between axes of the gun coupling and hose coupling being freely variable.

Thus, the extending direction of the air hose connected to the attachment can freely be changed horizontally and vertically.

Also, a pressure gauge is installed on the attachment to communicate with the outlet-side passage and indicates the pressure of air supplied through the passage. The pressure gauge is installed for a display surface thereof to form an obtuse angle in relation to the axis of the gun coupling, whereby the worker holding and operating the spray gun in a normal spray coating can easily view the display surface of the pressure gauge to check an air pressure.

With the attachment according to the present invention being installed on a spray gun, it is possible to easily check the pressure of air supplied to the spray gun. When the supplied air pressure has been varied and is to be adjusted, it can be finely adjusted using the control valve and the adjusted air pressure can accurately be checked. Thereby, it is possible to address a surface variation of an object to be coated and thus assure a quality coating and also minimize variation of coating quality, possibly caused by shift from one to another worker, interruption of the coating work or the like.

An obstacle, if any, existing below the spray gun during use will not be in contact with the air hose when the latter is moved late as indicated with a dotted line in FIG. 3, whereby the spray gun can be operated with a minimum limitation of its operationality and moving range.

The foregoing and other features, aspects and advantages of the present invention will become apparent from the following detailed description of the present invention when taken in conjunction with the accompanying drawings.

DETAILED DESCRIPTION OF THE PREFERRED EMBODIMENTS

Figure 1:
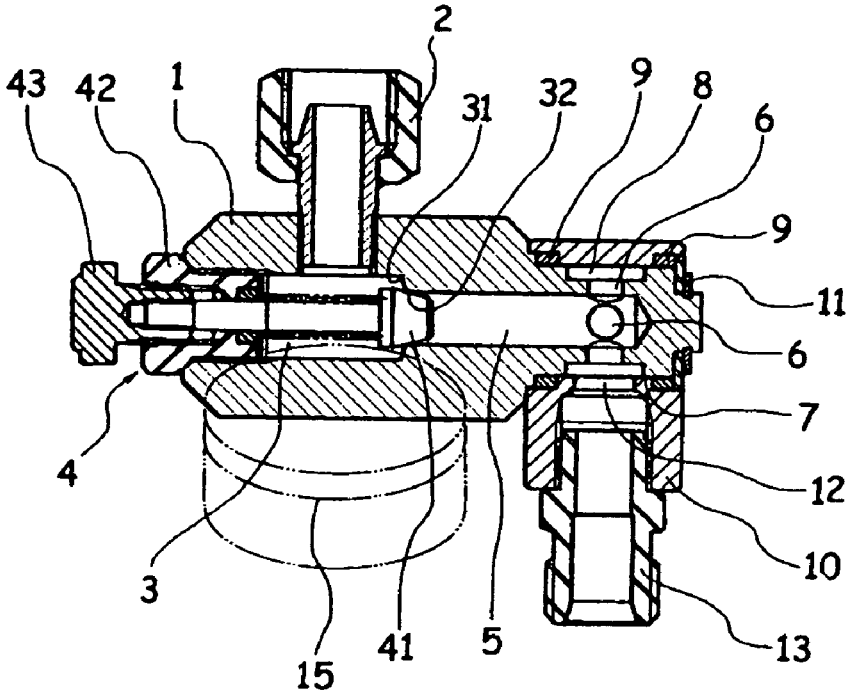
FIG. 1 is a sectional view of an attachment as one embodiment of the present invention, showing the entire structure.

FIG. 1 shows the entire structure of the air spray gun attachment as an embodiment of the present invention. As shown, the attachment includes a body 1 having a gun coupling 2 provided at the lateral side thereof for connection to the spray gun, and an air passage 3 formed axially at one end thereof to communicate with the gun coupling 2. The air passage 3 is stepped at an inner end 31 thereof to form a valve seat 32, and has a control valve 4 assembled on an opening-side end thereof to adjust the opening of the passage by moving a valve body 41 back and forth to adjust the flow rate of air flowing through the passage 3. The valve body 41 of the control valve 4 moving together with a knob 43 screwed in a guide 42 is moved back and forth as the knob 43 is rotated. The control valve 4 has a well-known structure but it may have any other structure included in the conventional art.

The valve seat 32 has an inlet-side passage 5 open at the small diameter thereof. The inlet-side passage 5 is open at least one communication hole 6 leading to the outer surface at the other end of the body 1. Communication holes 6 are formed at four circumferentially spaced locations in the illustrated embodiment. It is formed as a cylindrical hole at a cylindrical lateral opening portion 7 of the body 1, and as a recess 8 at the outer surface of the body 1. A gasket 9 is provided in the recess 8 to prevent air leakage, and a rotary joint 10 is fitted on the lateral portion 7. The rotary joint 10 is freely rotatable in relation to the cylindrical lateral portion 7, and a snap ring 11 is used to prevent the rotary joint 10 from being disengaged from the lateral portion 7. The rotary joint 10 has formed at one side thereof an inlet 12 leading to the recess 8 and to a hose coupling 13 to which an air hose extending from the air source is to be connected. Since the rotary joint 10 is rotatable in relation to the body 1 for use in a desired position, the recess 8 and communication hole 6 are large enough not to vary in size when the rotary joint 10 is rotated.

Figure 2:
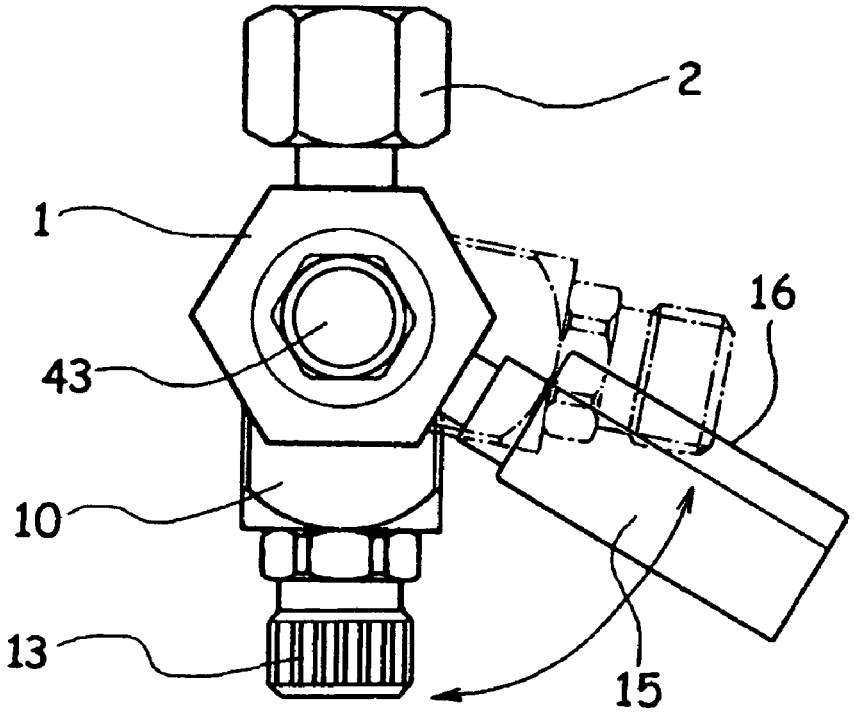
FIG. 2 is a lateral view, from the left, of the attachment in FIG. 1.
Figure 3:
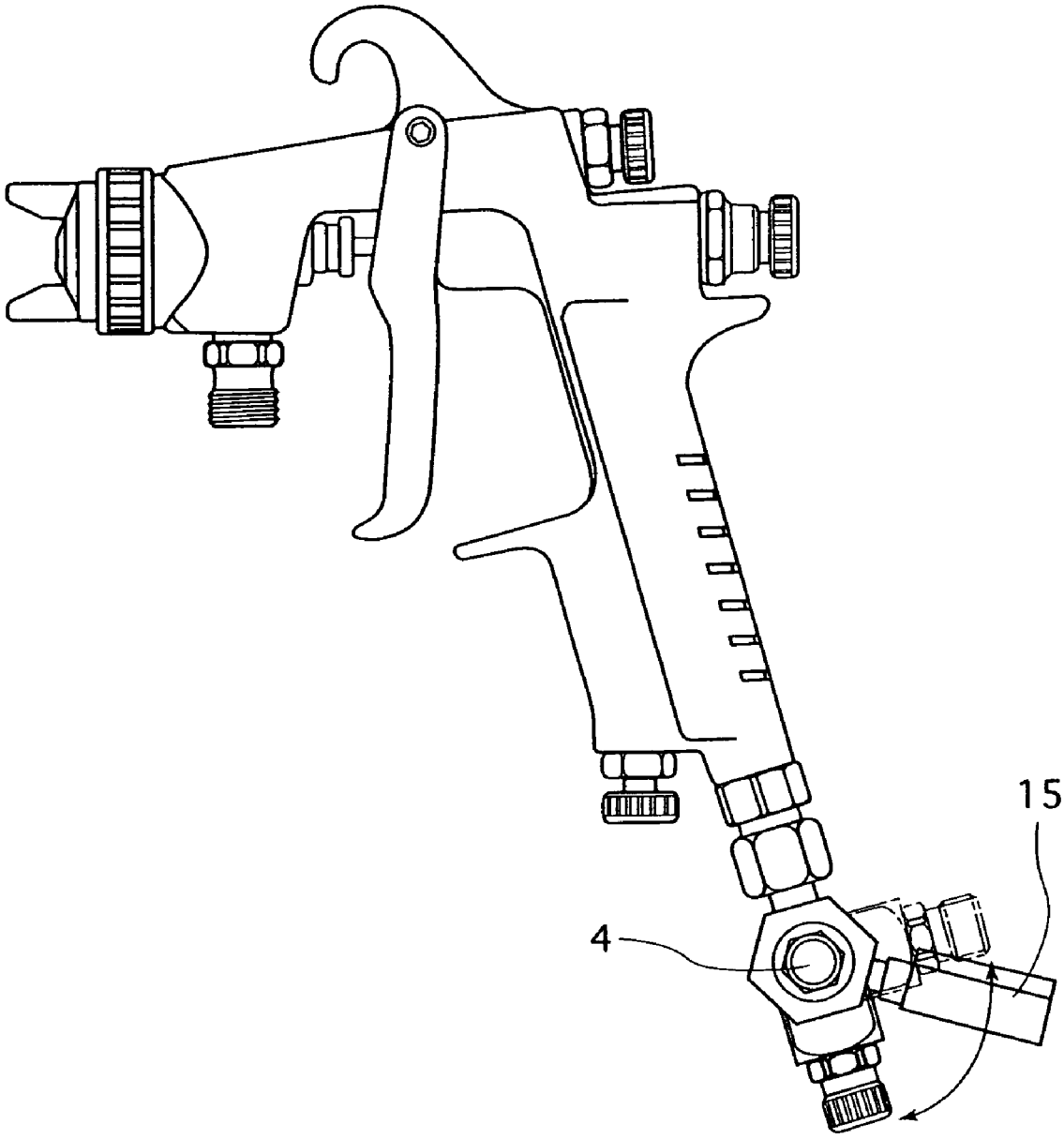
FIG. 3 shows a spray gun having the attachment in FIG. 1 connected thereto.

FIG. 3 shows the attachment installed on the spray gun. FIGS. 1 and 2 show the gun coupling connected to the grip of the spray gun and the hose coupling, the couplings being pointed in parallel directions as indicated with solid lines. With the hose coupling being in such a position, however, the air hose will extend straightly downward and any correct pointing of the spray nozzle is difficult depending upon the situation of the object. For example, in case an object portion is near the floor, the spraying cannot correctly be done. In this case, the hose coupling is to be turned laterally as indicated with a chained line in FIG. 3. Also, the spray gun can be placed upright while it is not being used during interruption of the spraying work.

FIG. 2 is a lateral view, from the left, of the attachment in FIG. 1. As shown, a pressure gauge 15 with a display surface 16 is installed on the attachment and is to be connected to the air passage 3. According to this embodiment, the display surface 16 of the pressure gauge 15 is tilted about 120 deg. in relation to the axis of the gun coupling 2. The pressure gauge 15 is of an analog bourdon tube type, but the present invention is not limited in structure and size to this pressure gauge 15. However, ease of viewing should be taken in account in selecting a pressure gauge for use with the present invention.

As above, the spray gun is normally supplied with an air pressure having been adjusted by a pressure reducing valve or the like provided separately. However, the actual air pressure fully supplied to the spray gun should be checked in many cases. In such cases, the pressure gauge installed on the attachment according to the present invention permits easy checking of the air pressure at the spray gun itself. When the air pressure has to be finely adjusted, the control valve included in the attachment permits immediate adjustment of the air pressure. The worker holding the spray gun will normally take a somewhat downward look at the pressure gauge of the attachment installed on the bottom of the spray gun. The obtuse positioning of the display surface 16 will permit easy viewing.

In the foregoing, the present invention has been described in detail concerning certain preferred embodiments thereof as examples with reference to the accompanying drawings. However, it should be understood by those ordinal skilled in the art that the present invention is not limited to the embodiments but can be modified in various manners, constructed alternatively or embodied in various other forms without departing from the scope and spirit thereof as set forth and defined in the appended claims.

What is claimed is:

1. An attachment for coupling an inlet of an air spray gun to an outlet of a compressed air supply hose, said attachment comprising:

an attachment body having a main air passage therein extending along a main air passage axis;

a control valve disposed in said main air passage to adjust an air flow rate through said main air passage;

a gun coupling configured to be coupled to the inlet of the air spray gun, said gun coupling being mounted to said attachment body and having an outlet air passage therein connected to said main air passage and arranged to allow passage of air from said main air passage to the inlet of the air spray gun;

a hose coupling configured to be coupled to the outlet of the compressed air supply hose, said hose coupling being mounted to said attachment body and having an inlet air passage therein connected to said main air passage and arranged to allow passage of air from the compressed air supply hose to said main air passage;

a pressure gauge mounted to said attachment body and fluidically coupled via a fluid coupling to said main air passage; and a rotary joint rotatably mounting said hose coupling to said attachment body such that an angle between an inlet air passage axis of said inlet air passage of said hose coupling and an outlet air passage axis of said outlet air passage of said gun coupling is variable;

wherein said pressure gauge has a display surface, and said pressure gauge is fixedly mounted to said attachment body in such a manner as to form an obtuse angle between said display surface and said outlet air passage axis and so that said display surface is generally parallel with a radiating direction in which said fluid coupling of said pressure gauge extends from said main air passage;

said control valve includes a valve body disposed in said main air passage and a valve knob exposed to an outside of said attachment body and coupled to said valve body for adjusting a position of said valve body in said main air passage of said attachment body;

wherein said valve knob is rotatable about said main air passage axis;

wherein said pressure gauge is coupled to said main air passage in a radiating manner with respect to said main air passage axis; and wherein said outlet air passage axis and said inlet air passage axis extend in a radiating direction from said main air passage axis.

2. The attachment according to claim 1, wherein said main air passage has an inlet end side, and a plurality of communication holes are formed in said attachment body so as to extend radially from said main air passage at said inlet end side thereof at circumferentially spaced locations about said main air passage; and said hose coupling is rotatably coupled to said attachment body via said rotary joint so that said inlet air passage of said hose coupling is coupled with at least one of said communication holes at each of plural rotary positions of said hose coupling with respect to said attachment body.

3. The attachment according to claim 2, wherein said gun coupling is mounted to said attachment body in such a manner that said outlet air passage axis is generally perpendicular to said main air passage axis; and said hose coupling is mounted to said attachment body in such a manner that said inlet air passage axis is generally perpendicular to said main air passage axis.

4. The attachment according to claim 3, wherein main air passage axis is generally perpendicular to said outlet air passage axis and is generally perpendicular to said inlet air passage axis.

5. The attachment according to claim 2, wherein said main air passage axis is generally perpendicular to said outlet air passage axis and is generally perpendicular to said inlet air passage axis.

6. The attachment according to claim 1, wherein said gun coupling is mounted to said attachment body in such a manner that said outlet air passage axis is generally perpendicular to said main air passage axis; and said hose coupling is mounted to said attachment body in such a manner that said inlet air passage axis is generally perpendicular to said main air passage axis.

7. The attachment according to claim 6, wherein said main air passage axis is generally perpendicular to said outlet air passage axis and is generally perpendicular to said inlet air passage axis.

8. The attachment according to claim 1, wherein said main air passage axis is generally perpendicular to said outlet air passage axis and is generally perpendicular to said inlet air passage axis.

* * * * *